US012791265B2

(12) United States Patent
Moriuchi

(10) Patent No.: US 12,791,265 B2
(45) Date of Patent: Nov. 10, 2026

(54) THERMAL CONDUCTOR

(71) Applicant: Tomoegawa Corporation, Tokyo (JP)

(72) Inventor: Hideki Moriuchi, Shizuoka (JP)

(73) Assignee: Tomoegawa Corporation, Tokyo (JP)

( * ) Notice: Subject to any disclaimer, the term of this patent is extended or adjusted under 35 U.S.C. 154(b) by 57 days.

(21) Appl. No.: 18/551,124

(22) PCT Filed: Mar. 7, 2022

(86) PCT No.: PCT/JP2022/009673
§ 371 (c)(1),
(2) Date: Sep. 18, 2023

(87) PCT Pub. No.: WO2022/202247
PCT Pub. Date: Sep. 29, 2022

(65) Prior Publication Data

US 2024/0167772 A1 May 23, 2024

(30) Foreign Application Priority Data

Mar. 25, 2021 (JP) ..... 2021-052418

(51) Int. Cl.
*F28F 3/02* (2006.01)
*F28F 3/04* (2006.01)

(52) U.S. Cl.
CPC ..... *F28F 3/022* (2013.01); *F28F 3/04* (2013.01)

(58) Field of Classification Search
CPC ..... F28F 3/022; F28F 3/04
USPC ..... 165/80.3, 133, 179, 180, 181, 182, 185
See application file for complete search history.

(56) References Cited

U.S. PATENT DOCUMENTS 5,351,748 A * 10/1994 Dagan ..... F28F 3/022 29/890.044
5,375,655 A * 12/1994 Lee ..... F28F 3/02 165/185
5,499,450 A * 3/1996 Jacoby ..... F28F 3/022 257/E23.105
5,673,177 A * 9/1997 Brodsky ..... H10W 40/228 257/713
5,726,495 A * 3/1998 Aihara ..... H10W 40/037 428/614

(Continued)

FOREIGN PATENT DOCUMENTS

JP 2017135227 A * 8/2017
JP 2000-101004 A 4/2020

(Continued)

OTHER PUBLICATIONS

Supplemental European Search Report for related application No. 2275041.1 dated Jul. 15, 2024 (9 pp).

(Continued)

*Primary Examiner* — Claire E Rojohn, III
(74) *Attorney, Agent, or Firm* — Renner, Kenner, Greive, Bobak, Taylor & Weber

(57) ABSTRACT

A thermal conductor (10) includes: a thermal-conduction portion (20) including metal; and a protrusion (30) attached to a surface of the thermal-conduction portion (20) and extending from the thermal-conduction portion (20), wherein the protrusion (30) includes a core (32) made of a metal bulk body, and a metal fiber structure (34) fusion-bonded around the core (32).

8 Claims, 6 Drawing Sheets

(56) References Cited

U.S. PATENT DOCUMENTS 6,009,937 A * 1/2000 Gonner ..... F28F 3/02 174/16.3
6,590,770 B1 * 7/2003 Rogers ..... H10W 40/226 257/722
6,771,508 B1 * 8/2004 Ghosh ..... F28F 3/022 361/708
6,817,405 B2 * 11/2004 Kamath ..... F28F 3/022 361/689
7,254,888 B2 * 8/2007 Chu ..... F28F 21/02 228/183
7,288,840 B2 * 10/2007 Furman ..... H10W 40/47 257/E23.098
7,301,770 B2 * 11/2007 Campbell ..... F28F 3/022 257/E23.09
7,420,810 B2 * 9/2008 Reis ..... C09K 5/041 257/713
7,446,412 B2 * 11/2008 Gwin ..... G06F 1/20 165/185
7,913,387 B2 * 3/2011 Chu ..... H10W 40/25 264/261
7,981,199 B2 * 7/2011 Burk ..... F25B 35/04 96/154
8,018,128 B2 * 9/2011 Egawa ..... H04N 9/315 165/80.4
8,018,720 B2 * 9/2011 Campbell ..... H05K 7/20809 165/185
8,054,629 B2 * 11/2011 Li ..... H05K 7/20418 257/722
8,535,787 B1 * 9/2013 Lima ..... B32B 27/06 428/458
8,695,687 B2 * 4/2014 Paschkewitz ..... B21D 53/06 165/146
9,997,435 B2 * 6/2018 Karidis ..... B23K 1/0014
10,302,371 B2 * 5/2019 Kadijk ..... F21V 29/81
2007/0000643 A1 * 1/2007 Tan ..... H10W 40/43 257/E23.099
2007/0017660 A1 * 1/2007 Kienitz ..... H10W 40/22 257/E23.098
2007/0091565 A1 * 4/2007 Malone ..... H05K 7/20145 257/E23.099
2007/0199677 A1 * 8/2007 Hwang ..... H10W 40/25 257/E23.099
2008/0066888 A1 * 3/2008 Tong ..... F28F 13/12 165/80.3
2010/0258270 A1 * 10/2010 Arik ..... H10W 40/43 165/80.3
2011/0056669 A1 * 3/2011 Pruett ..... B21D 53/02 165/122
2011/0174462 A1 * 7/2011 Arik ..... F28F 3/022 165/96
2013/0112379 A1 * 5/2013 Ko ..... F28F 19/02 427/372.2
2013/0258595 A1 * 10/2013 Tuckerman ..... H05K 7/20372 165/104.11
2013/0271920 A1 * 10/2013 Chun ..... H05K 7/2039 361/705
2014/0034282 A1 * 2/2014 Kawamura ..... C01B 32/16 165/185
2014/0054023 A1 * 2/2014 Kokubo ..... B21C 23/186 72/352
2014/0146534 A1 * 5/2014 Wang ..... F21V 29/83 362/249.02
2015/0007965 A1 * 1/2015 Joshi ..... F28F 1/122 165/185
2015/0036363 A1 * 2/2015 Fleskens ..... B29C 55/12 29/890.039
2016/0030234 A1 * 2/2016 Lofy ..... A61F 7/007 607/104
2017/0153072 A1 * 6/2017 Saiwai ..... F28D 15/02
2017/0248379 A1 * 8/2017 Kadijk ..... F21V 29/81
2020/0008316 A1 * 1/2020 Cola ..... F28F 21/06
2020/0158447 A1 * 5/2020 Kaibuchi ..... F28F 3/048
2022/0026162 A1 * 1/2022 Hatano ..... C09K 5/04
2023/0080550 A1 * 3/2023 Moriuchi ..... F28D 1/04 219/628
2023/0105760 A1 * 4/2023 Moriuchi ..... D21H 13/48 165/185
2023/0194193 A1 * 6/2023 Moriuchi ..... F28F 13/12 165/109.1
2023/0200006 A1 * 6/2023 Moriuchi ..... H05K 7/20263 165/80.4
2024/0167772 A1 * 5/2024 Moriuchi ..... F28F 3/022

FOREIGN PATENT DOCUMENTS

WO 2016/002870 A1 1/2016
WO 2021/070470 A1 4/2021

OTHER PUBLICATIONS

Specification and Drawings for JP Application No. 95895/1980 (Laid Open No. 36495/1982) dated Feb. 26, 1982 (23 pp).
English Translation of International Search Report dated May 12, 2022 for corresponding PCT/JP2022/009673 (2 pp).

* cited by examiner

THERMAL CONDUCTOR

TECHNICAL FIELD

The present invention relates to a thermal conductor for dissipating heat from a thermal-conduction target or providing heat to a thermal-conduction target.

BACKGROUND ART

Conventionally, various types of thermal conductors have been used for dissipating heat from a cooling target such as an electric component or an electronic component which generates heat, or providing heat to a heating target. As such thermal conductors, for example, a thermal conductor having a flat-plate base and a plurality of protrusions standing on an upper surface of the base and located at intersections of lattice lines, may be used. An example of such a thermal conductor is disclosed in WO2017/061307A1.

The thermal conductor disclosed in WO2017/061307A1 has a flat-plate base and a plurality of thin-plate fins standing on an upper surface of the base and arranged in substantially parallel to each other, and the base and the plurality of fins are formed integrally. In the thermal conductor, when the base and the fins are seen in a thickness direction, a fibrous filler is oriented in a plane direction in each of the base and the fins.

SUMMARY OF THE INVENTION

The above conventional thermal conductor has a problem that the strength of the fins is small. In addition, a thermal conductor having an improved thermal-conduction property is required.

The present invention has been made in view of the above circumstances and an object of the present invention is to provide a thermal conductor that can increase the strength of protrusions and obtain a sufficient thermal-conduction effect.

A thermal conductor of the present invention includes: a thermal-conduction portion including metal; and a protrusion attached to a surface of the thermal-conduction portion and extending from the thermal-conduction portion, wherein the protrusion includes a core made of a metal bulk body, and a first metal fiber structure fusion-bonded around the core.

DESCRIPTION OF THE PREFERRED EMBODIMENTS

Hereinafter, an embodiment of the present invention will be described with reference to the drawings. FIG. 1 to FIG. 6 show a thermal conductor according to the present embodiment. The thermal conductor according to the present embodiment is attached to a thermal-conduction target such as an electric component or an electronic component which generates heat, and thus dissipates heat from the thermal-conduction target. The thermal conductor according to the present embodiment may be used as a part of a heat exchange unit for taking heat from a surrounding environment to perform cooling, by being attached to a surface of a cooling unit in which a medium such as cooling water or cooling gas passes.

Figure 1:
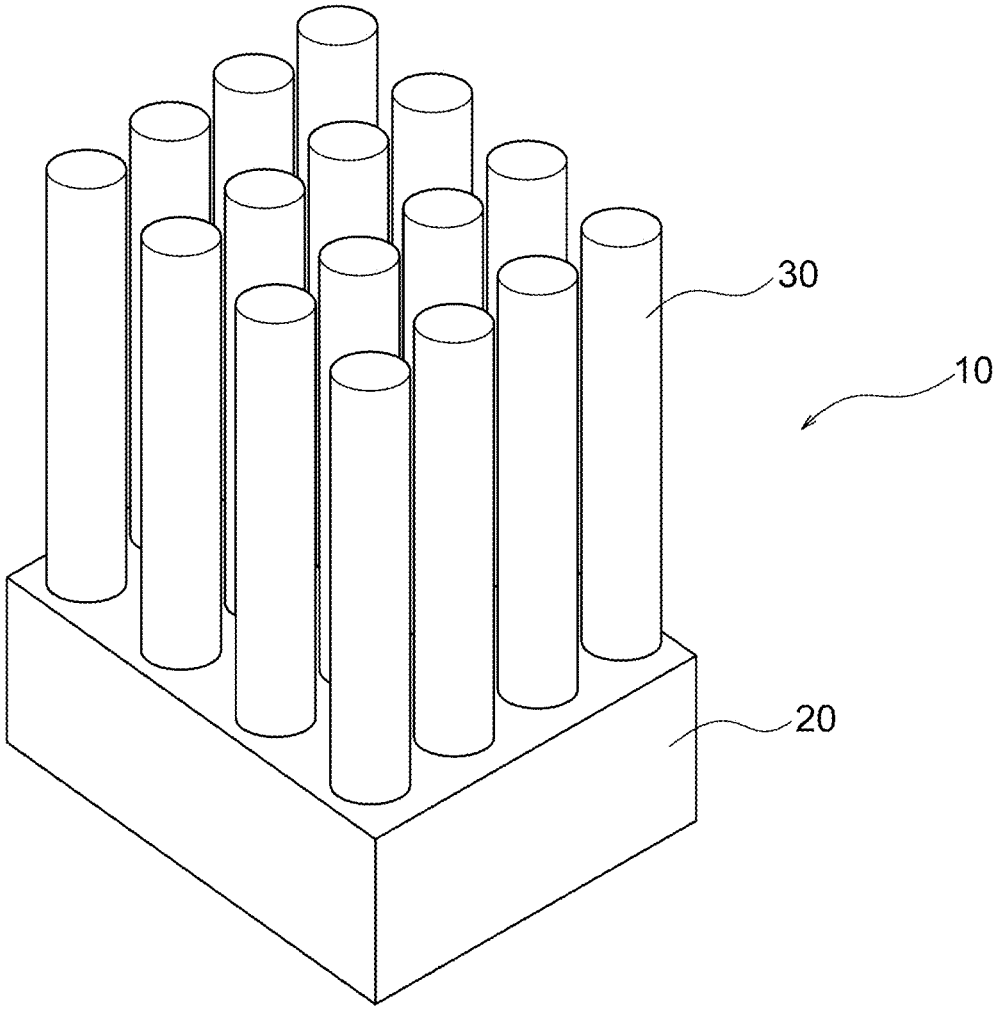
FIG. 1 is a perspective view of a thermal conductor according to an embodiment of the present invention.
Figure 2:
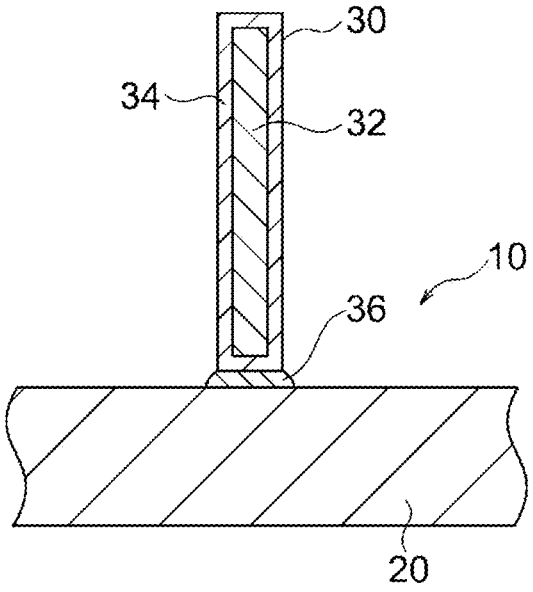
FIG. 2 is a vertical sectional view showing a structure example of a protrusion and a thermal-conduction portion of the thermal conductor shown in FIG. 1.
Figure 7:
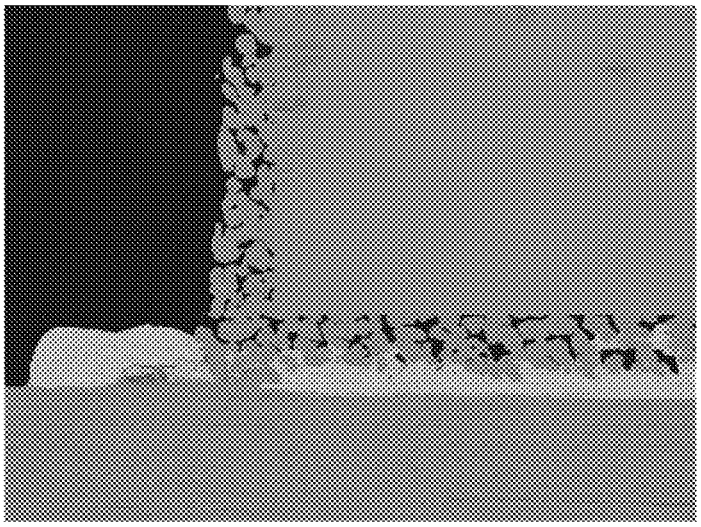
FIG. 7 is a photograph when the thermal conductor shown in FIG. 1 was cut along the vertical sectional view shown in FIG. 2.

As shown in FIG. 1 and FIG. 2, a thermal conductor 10 of the present embodiment includes a flat-plate thermal-conduction portion 20 to be attached to a thermal-conduction target, and a plurality of columnar protrusions 30 attached to a surface of the thermal-conduction portion 20 and extending from the thermal-conduction portion 20. Each protrusion 30 includes a core 32 made of a metal bulk body, and a metal fiber structure 34 (first metal fiber structure) fusion-bonded around the core 32. The metal fiber structure 34 is exposed. As shown in FIG. 2, each protrusion 30 is adhered to the thermal-conduction portion 20 by an adhesive 36 containing a metal paste. Each protrusion 30 may be fusion-bonded to the thermal-conduction portion 20, instead of being adhered thereto. Each component of the thermal conductor 10 will be described in detail. FIG. 7 is a photograph when the thermal conductor 10 shown in FIG. 1 was cut along the vertical sectional view shown in FIG. 2. This photograph was taken with a scanning electron microscope (SEM) manufactured by Nikon Corporation.

The thermal-conduction portion 20 is made of a bulk body of metal such as copper or aluminum, for example. The thermal-conduction portion 20 may be made of a metal fiber sheet, instead of a metal bulk body. As metal fibers included in the metal fiber sheet, metal-coated fibers may be used. The metal fibers included in the metal fiber sheet are formed by at least one of a nonwoven fabric, a woven fabric, a mesh, and the like formed through a dry or wet process. Preferably, a metal fiber nonwoven fabric in which metal fibers are bonded together is used as the metal fiber sheet.

Each protrusion 30 has the metal fiber structure 34 fusion-bonded around the core 32 made of a metal bulk body. The core 32 is made of a bulk body of metal such as copper or aluminum, for example. The metal fiber structure 34 includes a plurality of metal fibers. As the metal fibers included in the metal fiber structure 34, metal-coated fibers may be used. The metal fibers included in the metal fiber structure 34 are formed by at least one of a nonwoven fabric, a woven fabric, a mesh, and the like formed through a dry or wet process. Preferably, a metal fiber nonwoven fabric in which metal fibers are bonded together is used as the metal fiber structure 34.

A specific example of the metal forming the metal fibers included in the metal fiber structure 34 is not limited, and may be selected from the group consisting of stainless steel, iron, copper, aluminum, bronze, brass, nickel, chromium, and the like, or may be a noble metal selected from the group consisting of gold, platinum, silver, palladium, rhodium, iridium, ruthenium, osmium, and the like. Among them, copper fibers and aluminum fibers are preferable since these fibers have excellent thermal-conduction properties and moderate balance between rigidity and plastic deformability.

Here, the ratio of a contact area of the metal fiber structure 34 to an area of an outer peripheral surface of the core 32 at the joining interface between the core 32 and the metal fiber structure 34 of the protrusion 30 is preferably 20% to 80%, more preferably 30% to 70%, and even more preferably 40% to 60%. When the ratio of the contact area of the metal fiber structure 34 to the area of the outer peripheral surface of the core 32 is not less than 20%, the thermal-conduction property between the core 32 and the metal fiber structure 34 is excellent. When the ratio of the contact area of the metal fiber structure 34 to the area of the outer peripheral surface of the core 32 is not greater than 80%, the metal fiber structure 34 can be inhibited from being excessively fusion-bonded to the outer peripheral surface of the core 32.

The space factor of the metal fibers in the metal fiber structure 34 is preferably 30% to 80% and more preferably 40% to 70%. When the space factor of the metal fibers is not less than 30%, the amount of the metal fibers is sufficient and thus appropriate uniformity is obtained. When the space factor of the metal fibers is not greater than 80%, desired flexibility is obtained in addition to appropriate uniformity. As used herein, "the space factor of the metal fibers in the metal fiber structure 34" is the ratio of a part where the metal fibers are present to the volume of the metal fiber structure 34.

The presence ratio of the metal fibers in a cross-section of the metal fiber structure 34 is preferably 30% to 80% and more preferably 40% to 70%. Specifically, the presence ratio of the metal fibers in a cross-section of the metal fiber structure 34 taken along a plane perpendicular to the longitudinal direction (up-down direction in FIG. 2) of the protrusion 30 is preferably 30% to 80%. When the presence ratio of the metal fibers is not less than 30%, the amount of the metal fibers is sufficient and thus appropriate uniformity is obtained. When the presence ratio of the metal fiber is not greater than 80%, desired flexibility is obtained in addition to appropriate uniformity.

When the metal fiber structure 34 of the protrusion 30 is attached to the thermal-conduction portion 20 by the adhesive 36, the metal fiber structure 34 is compressed between the core 32 and the thermal-conduction portion 20 at a part indicated by reference character 34*a*, whereby the space factor of the metal fiber structure 34 is increased. In this case, the space factor of the metal fiber structure 34 at the joining interface between the surface of the thermal-conduction portion 20 and the protrusion 30 is preferably 40% to 80%. When the space factor of the metal fiber structure 34 is not less than 40%, the thermal-conduction property between the surface of the thermal-conduction portion 20 and the protrusion 30 can be improved. When the space factor of the metal fiber structure 34 is not greater than 80%, the metal fiber structure 34 can be prevented from being excessively compressed.

The bulk body forming the core 32 and the metal fibers forming the metal fiber structure 34 in the protrusion 30 are preferably made of the same kind of metal. In this case, occurrence of corrosion at the interface between the core 32 and the metal fiber structure 34 can be inhibited. That is, if the kind of metal forming the metal fibers included in the metal fiber structure 34 and the kind of metal forming the bulk body of the core 32 are different, current flows due to a potential difference between both metals, so that a hole might be formed in the metals. The present embodiment is not limited to the above case. In another case of the present embodiment, the bulk body forming the core 32 and the metal fibers forming the metal fiber structure 34 in the protrusion 30 may be made of different kinds of metals.

With the thermal conductor 10 configured as described above, the protrusion 30 includes the core 32 made of a metal bulk body, and the metal fiber structure 34 fusion-bonded around the core 32, whereby the strength of the protrusion 30 can be increased and a sufficient thermal-conduction effect can be obtained. More specifically, using the core 32 made of a metal bulk body can increase the strength of the protrusion 30. In addition, since the metal fiber structure 34 fusion-bonded around the core 32 is exposed, the surface area of the protrusion 30 can be increased, and a fluid flowing around the protrusion 30 forms a turbulent flow. Thus, the thermal-conduction property of the protrusion 30 can be improved, whereby the thermal conductor 10 can obtain a sufficient thermal-conduction effect.

Since one end of each protrusion 30 is adhered to the thermal-conduction portion 20 by the adhesive 36 containing a metal paste, the joining strength between each protrusion 30 and the thermal-conduction portion 20 can be increased.

Figure 3:
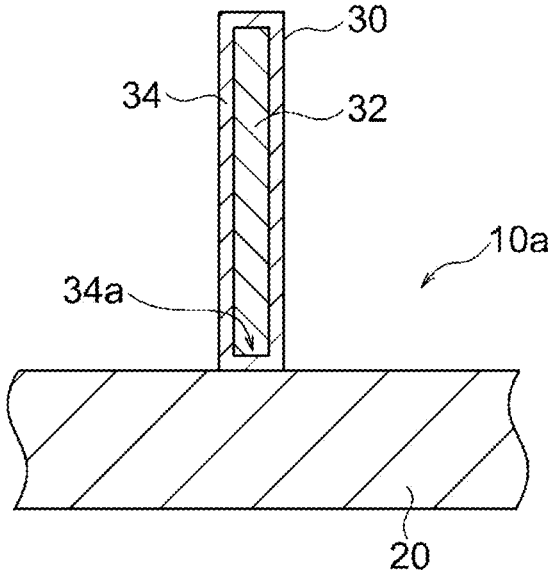
FIG. 3 is a vertical sectional view showing another structure example of the protrusion and the thermal-conduction portion of the thermal conductor.

The thermal conductor according to the present embodiment is not limited to the structure shown in FIG. 2. FIG. 3 is a vertical sectional view showing another structure example of the protrusion and the thermal-conduction portion of the thermal conductor. In description of a thermal conductor 10*a* shown in FIG. 3, the same components as those of the thermal conductor 10 shown in FIG. 1 and FIG. 2 are denoted by the same reference characters and the description thereof is omitted.

In the thermal conductor 10*a* shown in FIG. 3, as compared to the thermal conductor 10 shown in FIG. 1 and FIG. 2, instead of attaching the protrusion 30 to the thermal-conduction portion 20 by the adhesive 36, the metal fiber structure 34 of the protrusion 30 is fusion-bonded to the thermal-conduction portion 20. When the metal fiber structure 34 of the protrusion 30 is fusion-bonded to the thermal-conduction portion 20, the metal fiber structure 34 is compressed between the core 32 and the thermal-conduction portion 20 at a part indicated by reference character 34*a*, whereby the space factor of the metal fiber structure 34 is increased. In this case, the space factor of the metal fiber structure 34 at the joining interface between the surface of the thermal-conduction portion 20 and the protrusion 30 is preferably 40% to 80%. When the space factor of the metal fiber structure 34 is not less than 40%, the thermal-conduction property between the surface of the thermal-conduction portion 20 and the protrusion 30 can be improved. When the space factor of the metal fiber structure 34 is not greater than 80%, the metal fiber structure 34 can be prevented from being excessively compressed.

Even with the thermal conductor 10*a* as described above, as with the thermal conductor 10 shown in FIG. 1 and FIG.

2, the strength of the protrusion 30 can be increased and a sufficient thermal-conduction effect can be obtained.

In addition, since the metal fiber structure 34 of each protrusion 30 is fusion-bonded to the thermal-conduction portion 20, the joining strength between each protrusion 30 and the thermal-conduction portion 20 can be increased.

Figure 4:
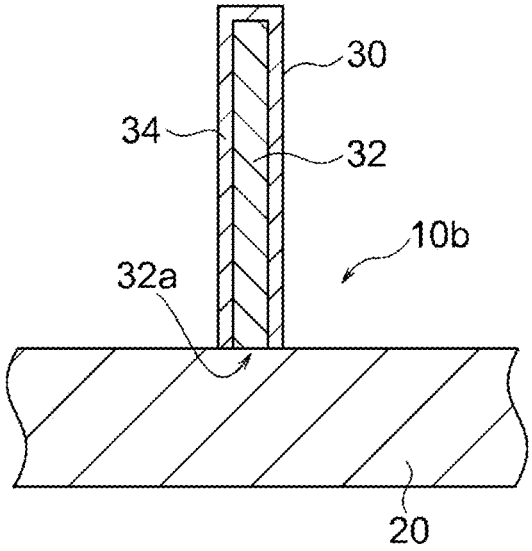
FIG. 4 is a vertical sectional view showing still another structure example of the protrusion and the thermal-conduction portion of the thermal conductor.

FIG. 4 is a vertical sectional view showing still another structure example of the protrusion and the thermal-conduction portion of the thermal conductor. In description of a thermal conductor 10*b* shown in FIG. 4, the same components as those of the thermal conductor 10 shown in FIG. 1 and FIG. 2 are denoted by the same reference characters and the description thereof is omitted.

In the thermal conductor 10*b* shown in FIG. 4, as compared to the thermal conductor 10 shown in FIG. 1 and FIG. 2, instead of attaching the protrusion 30 to the thermal-conduction portion 20 by the adhesive 36, the core 32 is exposed at around a lower end of the protrusion 30, and the part where the core 32 is exposed (part indicated by reference character 32*a* in FIG. 4) is fusion-bonded to the thermal-conduction portion 20. Even with the thermal conductor 10*b* as described above, as with the thermal conductor 10 shown in FIG. 1 and FIG. 2, the strength of the protrusion 30 can be increased and a sufficient thermal-conduction effect can be obtained.

In addition, since the core 32 of each protrusion 30 is fusion-bonded to the thermal-conduction portion 20, the joining strength between each protrusion 30 and the thermal-conduction portion 20 can be increased.

Figure 5:
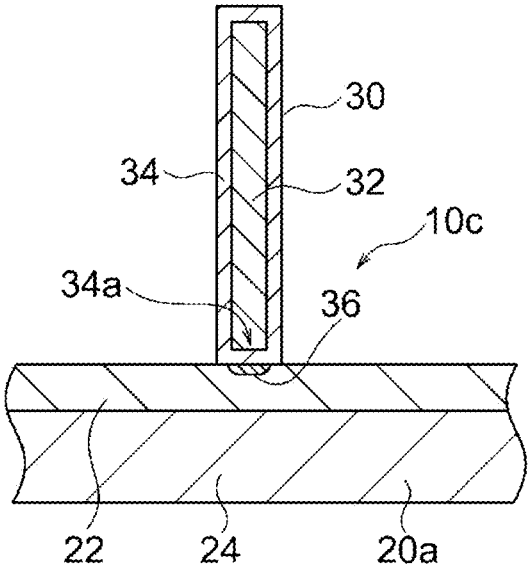
FIG. 5 is a vertical sectional view showing still another structure example of the protrusion and the thermal-conduction portion of the thermal conductor.
Figure 8:
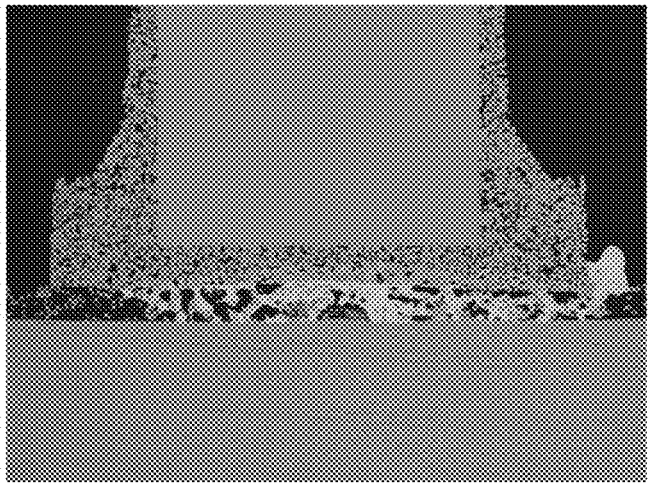
FIG. 8 is a photograph when the thermal conductor shown in FIG. 1 was cut along the vertical sectional view shown in FIG. 5.

FIG. 5 is a vertical sectional view showing still another structure example of the protrusion and the thermal-conduction portion of the thermal conductor. In description of a thermal conductor 10*c* shown in FIG. 5, the same components as those of the thermal conductor 10 shown in FIG. 1 and FIG. 2 are denoted by the same reference characters and the description thereof is omitted. FIG. 8 is a photograph when the thermal conductor 10*c* shown in FIG. 1 was cut along the vertical sectional view shown in FIG. 5. This photograph was taken with a scanning electron microscope (SEM) manufactured by Nikon Corporation.

In the thermal conductor 10*c* shown in FIG. 5, as compared to the thermal conductor 10 shown in FIG. 1 and FIG. 2, a thermal-conduction portion 20*a* is formed of a plurality of metal fiber sheets including a first layer 22 (surface layer) and a second layer 24. As the metal fibers included in the metal fiber sheets, metal-coated fibers may be used. The metal fibers included in the metal fiber sheets are formed by at least one of a nonwoven fabric, a woven fabric, a mesh, and the like formed through a dry or wet process. Preferably, a metal fiber nonwoven fabric in which metal fibers are bonded together is used as the metal fiber sheets. A specific example of the metal forming the metal fibers included in the metal fiber sheets is not limited, and may be selected from the group consisting of stainless steel, iron, copper, aluminum, bronze, brass, nickel, chromium, and the like, or may be a noble metal selected from the group consisting of gold, platinum, silver, palladium, rhodium, iridium, ruthenium, osmium, and the like. Among them, copper fibers and aluminum fibers are preferable since these fibers have excellent thermal-conduction properties and moderate balance between rigidity and plastic deformability. Here, the metal fiber sheet of the first layer 22 as described above forms a second metal fiber structure in the claims.

In the thermal conductor 10*c* shown in FIG. 5, the metal fiber structure 34 of the protrusion 30 is attached to the thermal-conduction portion 20 by the adhesive 36 penetrating into the metal fiber sheet of the first layer 22 of the thermal-conduction portion 20*a*. When the metal fiber structure 34 of the protrusion 30 is attached to the thermal-conduction portion 20, the metal fiber structure 34 is compressed between the core 32 and the thermal-conduction portion 20 at a part indicated by reference character 34*a*, whereby the space factor of the metal fiber structure 34 is increased. In this case, the space factor of the metal fiber structure 34 at the joining interface between the surface of the thermal-conduction portion 20 and the protrusion 30 is preferably 40% to 80%. When the space factor of the metal fiber structure 34 is not less than 40%, the thermal-conduction property between the surface of the thermal-conduction portion 20 and the protrusion 30 can be improved. When the space factor of the metal fiber structure 34 is not greater than 80%, the metal fiber structure 34 can be prevented from being excessively compressed.

Even with the thermal conductor 10*c* shown in FIG. 5, as with the thermal conductor 10 shown in FIG. 1 and FIG. 2, the strength of the protrusion 30 can be increased and a sufficient thermal-conduction effect can be obtained.

In addition, since the metal fiber structure 34 of the protrusion 30 is adhered to the thermal-conduction portion 20*a* by the adhesive 36 penetrating into the metal fiber sheet of the first layer 22 of the thermal-conduction portion 20*a*, the joining strength between each protrusion 30 and the thermal-conduction portion 20*a* can be increased.

Figure 6:
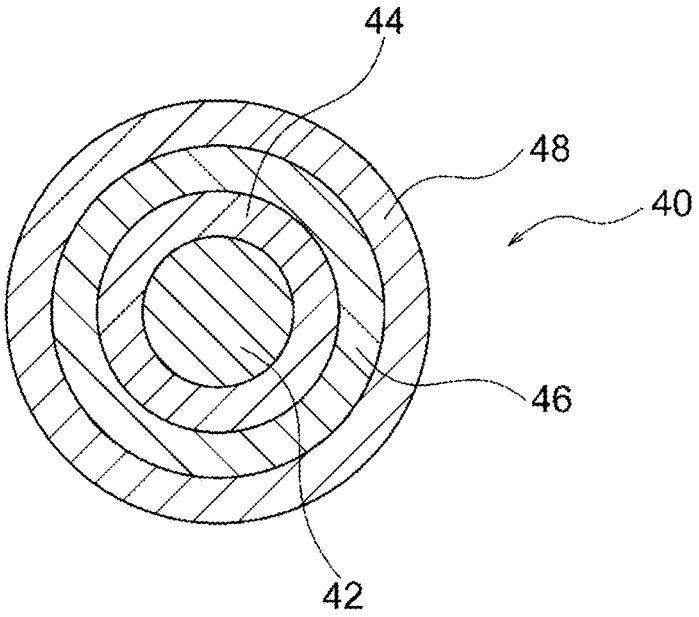
FIG. 6 is a horizontal sectional view showing still another structure example of the protrusion of the thermal conductor.

FIG. 6 is a horizontal sectional view showing still another structure example of the columnar protrusion of the thermal conductor. A protrusion 40 shown in FIG. 6 has a rod shape and is formed such that metal fiber structures 44, 48 having annular shapes and another bulk body 46 made of metal are fusion-bonded alternately in a multilayer form around the core 42 made of a metal bulk body. Specifically, the metal fiber structure 44 is fusion-bonded around the core 42, and another bulk body 46 is fusion-bonded around the metal fiber structure 44. Further, the metal fiber structure 48 is fusion-bonded around the other bulk body 46, and the metal fiber structure 48 is exposed. Even with the thermal conductor having the protrusion 40 as described above, as with the thermal conductor 10 shown in FIG. 1 and FIG. 2, the strength of the protrusion 40 can be increased and a sufficient thermal-conduction effect can be obtained. More specifically, using the core 42 made of a metal bulk body can increase the strength of the protrusion 40. In addition, since the metal fiber structure 48 is exposed, the surface area of the protrusion 30 can be increased, and a fluid flowing around the protrusion 40 forms a turbulent flow. Thus, the thermal-conduction property of the protrusion 40 can be improved, whereby the thermal conductor can obtain a sufficient thermal-conduction effect.

In the above description, the protrusion 30 has a rod shape, but the present embodiment is not limited thereto. The plurality of protrusions attached to the surface of the thermal-conduction portion 20 may have plate shapes extending in parallel to each other.

EXAMPLES

Hereinafter, the present invention will be described in more detail, using examples and comparative examples.

Figure 9:
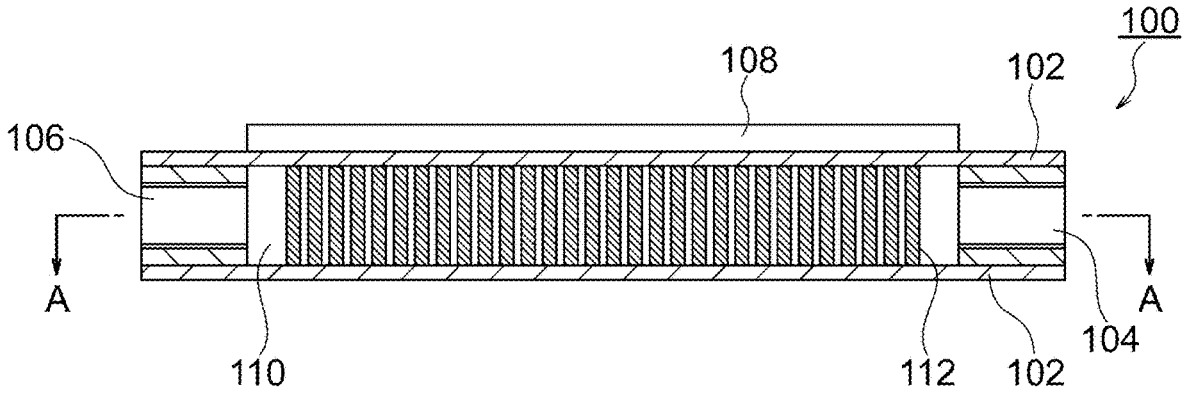
FIG. 9 is a vertical sectional view showing a structure of a heat exchanger according to examples and modifications.
Figure 10:
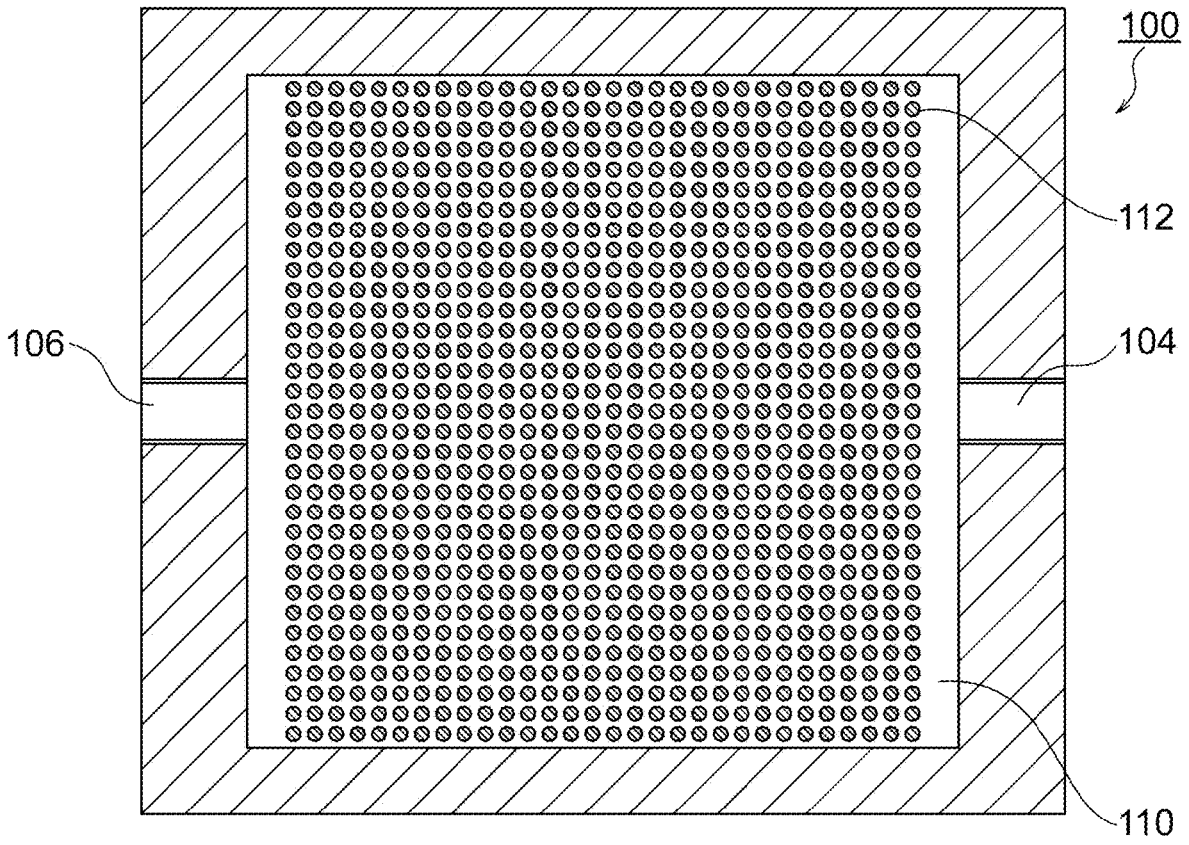
FIG. 10 is a sectional view of the heat exchanger shown in FIG. 9, along line A-A.

For evaluating the thermal conductivities of thermal conductors according to examples and comparative examples, a heat exchanger 100 shown in FIG. 9 and FIG. 10 was manufactured. In the heat exchanger 100 shown in FIG. 9 and FIG. 10, water is supplied through an entrance 104 to an area 110 between a pair of plate-shaped members 102, and the water passes through the area between the pair of plate-shaped members 102 and is discharged through an exit 106 to outside. The area 110 formed between the plate-shaped members 102 is a rectangular-parallelepiped space with a length of 10 cm, a width of 10 cm, and a height of 1.5 cm. In the area 110, 990 columnar rod-shaped members 112 with an outer diameter of 2 mm and a height of 15 mm are provided. Both ends of each rod-shaped member 112 are attached to the plate-shaped members 120, and the rod-shaped members 112 are located at intersections of lattice lines so as to extend in a direction perpendicular to the plate-shaped members 102. The distance between the rod-shaped members 112 is 3 mm. Water supplied through the entrance 104 to the area 110 passes between the rod-shaped members 112 and is discharged through the exit 106.

A heater 108 with a size of 10 square cm was provided at one plate-shaped member 102 of the heat exchanger 100 as described above. The power density of the heater 108 was 3.2 W/cm$^2$. Water was supplied through the entrance 104 to the area 110 at 0.5 L/min, the water in the area 110 was heated by the heater 108, and then the water was discharged through the exit 106. Using the heat exchanger 100 as described above, thermal conductivities were measured for the rod-shaped members 112 shown in Examples 1 to 8 and Comparative examples 1 and 2 below.

Example 1

In the heat exchanger 100 according to Example 1, as shown in FIG. 4, each rod-shaped member 112 included a columnar core made of a copper bulk body and a metal fiber structure made of copper fibers and fusion-bonded around the core, and the core was fusion-bonded to the plate-shaped member 102. Here, the diameter of the core was 2 mm, and the thickness of the metal fiber structure fusion-bonded around the core was 0.1 mm. The ratio of a contact area of the metal fiber structure to an area of an outer peripheral surface of the core at the joining interface between the core and the metal fiber structure was 50%. The space factor of the copper fibers in the metal fiber structure was 54%. The presence ratio of the metal fibers in a cross-section of the metal fiber structure was 55%. The space factor of the metal fiber structure at the joining interface between the surface of the plate-shaped member 102 and the rod-shaped member 112 was 53%.

Example 2

In the heat exchanger 100 according to Example 2, as shown in FIG. 4, each rod-shaped member 112 included a columnar core made of a copper bulk body and a metal fiber structure made of copper fibers and fusion-bonded around the core, and the core was fusion-bonded to the plate-shaped member 102. Here, the diameter of the core was 2 mm, and the thickness of the metal fiber structure fusion-bonded around the core was 0.1 mm. In fusion-bonding the metal fiber structure around the core, first, the outer peripheral surface of the core was coated with nano silver particles, and then the metal fiber structure was fusion-bonded. In the rod-shaped member 112 as described above, the ratio of a contact area of the metal fiber structure to an area of an outer peripheral surface of the core at the joining interface between the core and the metal fiber structure was 77%. The space factor of the copper fibers in the metal fiber structure was 56%. The presence ratio of the metal fibers in a cross-section of the metal fiber structure was 68%. The space factor of the metal fiber structure at the joining interface between the surface of the plate-shaped member 102 and the rod-shaped member 112 was 78%.

Example 3

In the heat exchanger 100 according to Example 3, as shown in FIG. 4, each rod-shaped member 112 included a columnar core made of a copper bulk body and a metal fiber structure made of copper fibers and fusion-bonded around the core, and the core was fusion-bonded to the plate-shaped member 102. Here, the diameter of the core was 2 mm, and the thickness of the metal fiber structure fusion-bonded around the core was 0.1 mm. The ratio of a contact area of the metal fiber structure to an area of an outer peripheral surface of the core at the joining interface between the core and the metal fiber structure was 72%. The space factor of the copper fibers in the metal fiber structure was 79%. The presence ratio of the metal fibers in a cross-section of the metal fiber structure was 76%. The space factor of the metal fiber structure at the joining interface between the surface of the plate-shaped member 102 and the rod-shaped member 112 was 74%.

Example 4

In the heat exchanger 100 according to Example 4, as shown in FIG. 3, each rod-shaped member 112 included a columnar core made of a copper bulk body and a metal fiber structure made of copper fibers and fusion-bonded around the core, and the metal fiber structure was fusion-bonded to the plate-shaped member 102. Here, the diameter of the core was 2 mm, and the thickness of the metal fiber structure fusion-bonded around the core was 0.1 mm. The ratio of a contact area of the metal fiber structure to an area of an outer peripheral surface of the core at the joining interface between the core and the metal fiber structure was 23%. The space factor of the copper fibers in the metal fiber structure was 32%. The presence ratio of the metal fibers in a cross-section of the metal fiber structure was 34%. The space factor of the metal fiber structure at the joining interface between the surface of the plate-shaped member 102 and the rod-shaped member 112 was 41%.

Example 5

In the heat exchanger 100 according to Example 5, as shown in FIG. 2, each rod-shaped member 112 included a columnar core made of a copper bulk body and a metal fiber structure made of copper fibers and fusion-bonded around the core, and the metal fiber structure was fusion-bonded to the plate-shaped member 102 by an adhesive containing nano silver particles. Here, the diameter of the core was 2 mm, and the thickness of the metal fiber structure fusion-bonded around the core was 0.1 mm. The ratio of a contact area of the metal fiber structure to an area of an outer peripheral surface of the core at the joining interface between the core and the metal fiber structure was 40%. The space factor of the copper fibers in the metal fiber structure was 42%. The presence ratio of the metal fibers in a cross-section of the metal fiber structure was 42%. The space factor of the metal fiber structure at the joining interface between the surface of the plate-shaped member 102 and the rod-shaped member 112 was 41%.

Example 6

In the heat exchanger 100 according to Example 6, as shown in FIG. 4, each rod-shaped member 112 included a columnar core made of a copper bulk body and a metal fiber structure made of copper fibers and fusion-bonded around the core, and the core was fusion-bonded to the plate-shaped member 102. Here, the diameter of the core was 2 mm, and the thickness of the metal fiber structure fusion-bonded around the core was 0.1 mm. In the rod-shaped member 112 as described above, the ratio of a contact area of the metal fiber structure to an area of an outer peripheral surface of the core at the joining interface between the core and the metal fiber structure was 61%. The space factor of the copper fibers in the metal fiber structure was 61%. The presence ratio of the metal fibers in a cross-section of the metal fiber structure was 63%. The space factor of the metal fiber structure at the joining interface between the surface of the plate-shaped member 102 and the rod-shaped member 112 was 62%.

Example 7

In the heat exchanger 100 according to Example 7, as shown in FIG. 3, each rod-shaped member 112 included a columnar core made of a copper bulk body and a metal fiber structure made of copper fibers and fusion-bonded around the core, and the metal fiber structure was fusion-bonded to the plate-shaped member 102. Here, the diameter of the core was 2 mm, and the thickness of the metal fiber structure fusion-bonded around the core was 0.1 mm. In fusion-bonding the metal fiber structure 34 to the plate-shaped member 102, the metal fiber structure between the core and the plate-shaped member 102 was compressed so as to increase the space factor of the metal fiber structure. In the rod-shaped member 112 as described above, the ratio of a contact area of the metal fiber structure to an area of an outer peripheral surface of the core at the joining interface between the core and the metal fiber structure was 21%. The space factor of the copper fibers in the metal fiber structure was 32%. The presence ratio of the metal fibers in a cross-section of the metal fiber structure was 33%. The space factor of the metal fiber structure at the joining interface between the surface of the plate-shaped member 102 and the rod-shaped member 112 was 73%.

Example 8

In the heat exchanger 100 according to Example 8, as shown in FIG. 3, each rod-shaped member 112 included a columnar core made of a copper bulk body and a metal fiber structure made of copper fibers and fusion-bonded around the core, and the metal fiber structure was fusion-bonded to the plate-shaped member 102. Here, the diameter of the core was 2 mm, and the thickness of the metal fiber structure fusion-bonded around the core was 0.1 mm. In fusion-bonding the metal fiber structure 34 to the plate-shaped member 102, the metal fiber structure between the core and the plate-shaped member 102 was compressed so as to increase the space factor of the metal fiber structure. In the rod-shaped member 112 as described above, the ratio of a contact area of the metal fiber structure to an area of an outer peripheral surface of the core at the joining interface between the core and the metal fiber structure was 55%. The space factor of the copper fibers in the metal fiber structure was 58%. The presence ratio of the metal fibers in a cross-section of the metal fiber structure was 57%. The space factor of the metal fiber structure at the joining interface between the surface of the plate-shaped member 102 and the rod-shaped member 112 was 72%.

Comparative Example 1

In the heat exchanger 100 according to Comparative example 1, each rod-shaped member 112 was formed of a columnar metal fiber structure made of copper fibers. The diameter of the metal fiber structure as described above was 2.1 mm. In the rod-shaped member 112 as described above, the space factor of the copper fibers in the metal fiber structure was 54%. The presence ratio of the metal fibers in a cross-section of the metal fiber structure was 54%. The space factor of the metal fiber structure at the joining interface between the surface of the plate-shaped member 102 and the rod-shaped member 112 was 53%.

Comparative Example 2

In the heat exchanger 100 according to Comparative example 2, each rod-shaped member 112 was formed of only a columnar core made of a copper bulk body. The diameter of the core was 2.0 mm. In the rod-shaped member 112 as described above, the space factor of the rod-shaped member 112 at the joining interface between the surface of the plate-shaped member 102 and the rod-shaped member 112 was 100%.

Evaluation

For the heat exchanger 100 having the rod-shaped members 112 according to each of Examples 1 to 8 and Comparative examples 1 and 2, the breaking strength of each rod-shaped member 112 and the thermal conductivity of the heat exchanger 100 were measured. The measurement results are shown in Tables 1 and 2 below.

TABLE 1

| | Example 1 | Example 2 | Example 3 | Example 4 | Example 5 |
|---|---|---|---|---|---|
| Breaking strength ($N/mm^2$) | 229 | 224 | 231 | 223 | 230 |
| Thermal conductivity ($W/m^2 \cdot k$) | 6,835 | 7,034 | 7,250 | 6,010 | 6,402 |

TABLE 2

| | Example 6 | Example 7 | Example 8 | Comparative example 1 | Comparative example 2 |
|---|---|---|---|---|---|
| Breaking strength ($N/mm^2$) | 231 | 228 | 221 | 35 | 224 |
| Thermal conductivity ($W/m^2 \cdot k$) | 6,940 | 6,250 | 6,620 | 5,420 | 5,779 |

The rod-shaped members 112 according to Examples 1 to 10 had breaking strengths of not less than 200 $N/mm^2$, and thus sufficient breaking strengths were kept, whereas the rod-shaped member 112 according to Comparative example 1 had a breaking strength of 35 $N/mm^2$, and thus the strength of the rod-shaped member 112 was lower. The heat exchanger 100 having the rod-shaped members 112 according to each of Examples 1 to 10 had a thermal conductivity of 6,000 $W/m^2 \cdot k$, and thus the thermal conductivity was greater than that of the heat exchanger 100 having the rod-shaped members 112 according to each of Comparative Examples 1 and 2. Thus, it has been found that the heat exchanger 100 having the rod-shaped members 112 according to each of Examples 1 to 10 can obtain a sufficient thermal-conduction effect.

The invention claimed is:

1. A thermal conductor comprising:

a thermal-conduction portion including a surface and comprising metal; and a protrusion extending from the thermal-conduction portion, wherein the protrusion includes a core made of a metal bulk body, and a first metal fiber structure fusion-bonded around the core, and one end of the protrusion is attached to the surface of the thermal conduction portion via a fusion bond or an adhesive containing a metal paste, and wherein the core is separated by the first metal fiber structure from the thermal-conduction portion at a joining interface;

wherein a ratio of a contact area of the first metal fiber structure to an area of an outer peripheral surface of the core at the joining interface between the core and the first metal fiber structure of the protrusion is 20% to 80%;

wherein a space factor of metal fibers in the first metal fiber structure is 30% to 80%;

wherein a presence ratio of metal fibers in a cross-section of the first metal fiber structure is 30% to 80%; and wherein a space factor of the first metal fiber structure at the joining interface between a surface of the thermal-conduction portion and the protrusion is 40% to 80%.

2. The thermal conductor according to claim 1, wherein the first metal fiber structure of the protrusion is fusion-bonded to the thermal-conduction portion.

3. The thermal conductor according to claim 1, wherein the core of the protrusion is fusion-bonded to the thermal-conduction portion.

4. The thermal conductor according to claim 1, wherein the thermal-conduction portion has a surface layer including a second metal fiber structure, and the protrusion is attached to a surface of the surface layer.

5. The thermal conductor according to claim 1, wherein the protrusion has a rod shape or a plate shape.

6. The thermal conductor according to claim 1, wherein the protrusion has a rod shape and is formed such that the first metal fiber structures having annular shapes and another bulk body made of metal are fusion-bonded alternately in a multilayer form around the core.

7. The thermal conductor according to claim 1, wherein the one end of the protrusion is attached to the surface of thermal-conduction portion via a fusion bond.

8. The thermal conductor according to claim 1, wherein the one end of the protrusion is attached to the surface of thermal-conduction portion via the adhesive containing the metal paste.

* * * * *